United States Patent [19]

Ferleger

[11] Patent Number: 4,781,534

[45] Date of Patent: Nov. 1, 1988

[54] APPARATUS AND METHOD FOR REDUCING WINDAGE AND LEAKAGE IN STEAM TURBINE INCORPORATING AXIAL ENTRY BLADE

[75] Inventor: Jurek Ferleger, Longwood, Fla.

[73] Assignee: Westinghouse Electric Corp., Pittsburgh, Pa.

[21] Appl. No.: 20,045

[22] Filed: Feb. 27, 1987

[51] Int. Cl.[4] ..... F01D 5/30

[52] U.S. Cl. ..... 416/193 A; 416/220 R; 416/221

[58] Field of Search ..... 416/193 A, 219 R, 220 R, 416/221

[56] References Cited

U.S. PATENT DOCUMENTS

| | | | |
|---|---|---|---|
| 1,873,956 | 8/1932 | Dahlstrand | 416/220 X |
| 2,006,683 | 7/1935 | Meininghaus | 416/221 X |
| 3,039,740 | 6/1962 | Hockert | 416/221 |
| 3,077,811 | 2/1963 | Moore | 416/220 X |
| 3,096,074 | 7/1963 | Pratt et al. | 416/221 X |
| 3,157,385 | 11/1964 | Jenson | 416/221 |
| 3,300,179 | 1/1967 | Gooderum | 416/221 |
| 3,397,865 | 8/1968 | Catlow et al. | 416/221 |
| 3,503,696 | 3/1970 | Bauger et al. | 416/221 X |
| 3,656,865 | 4/1972 | Spears | 416/221 |
| 3,700,354 | 10/1972 | Memery | 416/221 X |
| 3,807,898 | 4/1974 | Guy et al. | 416/221 X |
| 3,841,792 | 10/1974 | Amos | 416/220 X |
| 3,850,546 | 11/1974 | Mason | 416/193 A X |
| 4,108,571 | 8/1978 | Mawson | 416/221 |
| 4,326,835 | 4/1982 | Wertz | 416/193 A |
| 4,533,298 | 8/1986 | Partington et al. | 416/191 |
| 4,602,412 | 7/1986 | Partington | 29/156.8 B |

FOREIGN PATENT DOCUMENTS

| | | | |
|---|---|---|---|
| 604830 | 9/1960 | Canada | 416/221 |
| 2542394 | 4/1976 | Fed. Rep. of Germany | 416/220 R |
| 443192 | 2/1975 | U.S.S.R. | 416/220 R |
| 881354 | 11/1981 | U.S.S.R. | 416/220 R |
| 691380 | 5/1953 | United Kingdom | 416/221 |
| 905582 | 9/1962 | United Kingdom | 416/221 |

*Primary Examiner*—Everette A. Powell, Jr.

[57] ABSTRACT

A steam turbine of the type employing a plurality of axial entry blades has a first annular plate juxtaposed one side of the disc that overlays the grooves in the disc and faces of the platforms of the blades. If desired, a second similar annular plate may be provided on the other side of the disc. The annular plates reduce windage and leakage.

14 Claims, 4 Drawing Sheets

APPARATUS AND METHOD FOR REDUCING WINDAGE AND LEAKAGE IN STEAM TURBINE INCORPORATING AXIAL ENTRY BLADE

BACKGROUND OF THE INVENTION

1. Field of the Invention

The present invention relates generally to any turbomachinery equipment with "axial entry" blades. More specifically, the present invention relates to steam turbines of the type employing "axial entry" blades. The invention has particular application to steam turbines of the type wherein the blades have a generally fir tree shaped root in registration with a generally fir tree shaped groove.

2. Description of the Prior Art

Steam turbines of the type employing "axial entry" blades are known. In such turbines, the disc (i.e., the portion of the rotor that holds the blades) has a plurality of generally fir tree shaped, generally axially extending grooves disposed therearound. A plurality of blades are circularly disposed around the disc. Each blade has a generally fir tree shaped root in registration with one of the grooves.

A problem with such turbines is that windage losses may be created by misalignment between the faces of the root and the disc. Misalignment may also be present between adjacent blade platforms, also adding to windage losses. Further, a small clearance often exists between each root and the edges of the groove with which it registers, as well as between and under the blade platforms, which provides a leakage path for steam. These conditions are undesirable.

SUMMARY OF THE INVENTION

An apparatus and method for reducing windage and leakage in a steam turbine comprises an annular plate juxtaposed either the inlet side, or exit side, or both, of the disc and overlaying both the grooves in the disc and the face of each blade platform. The annular plate has integral retaining means for maintaining the plate in juxtaposition with the disc. According to the preferred embodiment, the annular plate has an outside radius approximate the radius of the disc plus the thickness of the blade platform, and an inside radius approximate the radial distance from the center of the disc to the bottom of the grooves. Also, according to the preferred embodiment, the retaining means comprises a plurality of spaced apart prongs that are integral with the annular plate. The prongs extend through gaps provided between the bottom most portions of ones of the roots and the bottom of the grooves with which those roots register. Each prong has a free end that is bent either radially outward or radially inward on the side of the disc opposite that on which the plate is juxtaposed. Each free end may be seated in a recessed area in the face of a root if bent radially outward. If two annular plates are provided, i.e., one on each side of the disc, then the second annular plate is juxtaposed the side of the disc opposite that on which the first annular plate is juxtaposed. The second annular plate also overlays the grooves in the disc and the face of each blade platform. The second annular plate also has a plurality of integral prongs that extend through other ones of the gaps than the prongs of the first annular plate. The prongs of the second annular plate each have a free end that is bent either radially outward or radially inward on the side of the disc opposite that on which the second plate is juxtaposed. Each free end may be seated in a recessed area in the face of a root if bent radially outward.

A method of assembling a turbine to incorporate the above-described apparatus is also disclosed.

DESCRIPTION OF THE PREFERRED EMBODIMENT

Figure 1:
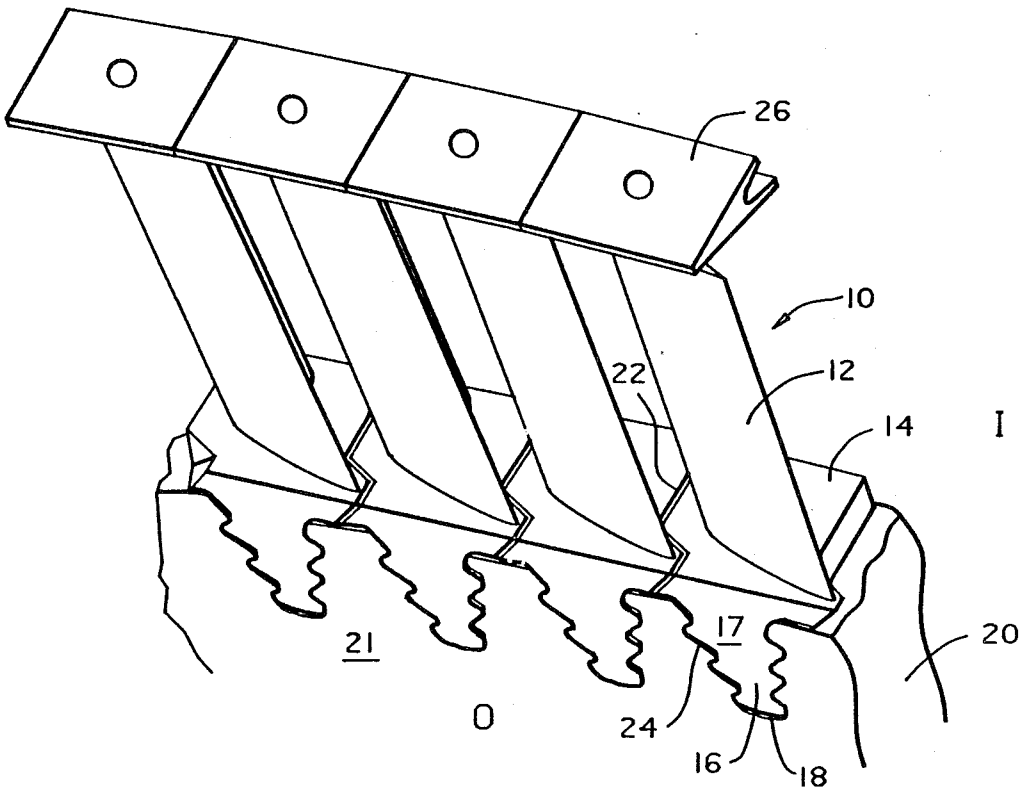
FIG. 1 is a perspective view of a portion of a turbine with axial entry blades.

Referring to the drawings wherein like numerals represent like elements, there is illustrated in FIG. 1 a portion of a turbine labeled generally 10. The turbine comprises a disc 20 having a plurality of blades 12 circularly disposed therearound. Each blade 12 has a platform 14 and may have an integral shroud 26 disposed at the distal end thereof. It should be understood, however, that the present invention is not limited in application to turbines of the type employing integral shroud blades and may be used with turbines employing free standing or grouped (lashed and/or riveted) blades. As also illustrated in FIG. 1, there are a plurality of generally fir tree shaped, generally axially extending grooves 18 disposed around the disc 20. The disc 20 has an inlet side I and an exit side O. Each blade 12 has a generally fir tree shaped root 16 at the proximal end thereof in registration with one of the grooves 18. Further, each root 16 has a face 17 disposed on the exit side O of the disc and another face (not shown) disposed on the inlet side I of the rotor.

As also illustrated in FIG. 1, there is usually a small clearance 22 between adjacent platforms 14. Moreover, there is generally a small clearance 24 between each blade root 16 and the edges of groove 18 with which the root registers (all clearances illustrated in FIG. 1 are exaggerated for clarity). Still further, as also illustrated in FIG. 1, the exit side face 17 of each root 16 is often not precisely aligned with the exit side face 21 of the disc 20, and the inlet side faces of the roots (not shown) are often not precisely aligned with the inlet side face of the disc 20. The misalignment between the faces of the roots and the face of the disc 21 may cause windage loss (also called "disc friction loss"), thus negatively affecting the efficiency of the turbine. Additionally, the clearances 22 and 24 provide leakage paths for steam that also negatively affect the efficiency of the turbine.

Figure 2:
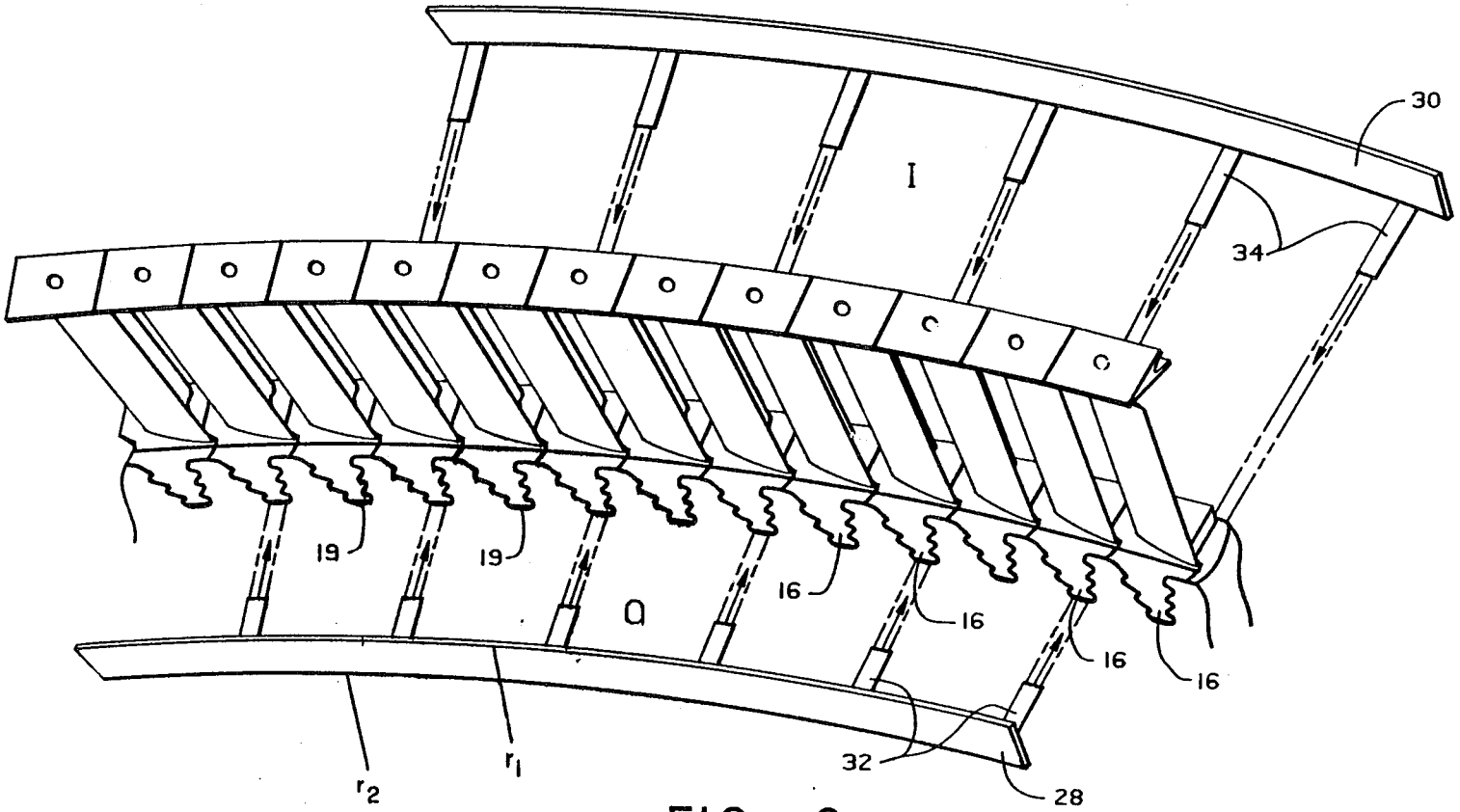
FIG. 2 is a perspective view of a portion of a turbine with axial entry blades and illustrates an intermediate step in the method of assembling a row of blades according to the present invention.

Turning to FIG. 2, a method and apparatus for reducing the windage and leakage losses will be described.

Figure 3:
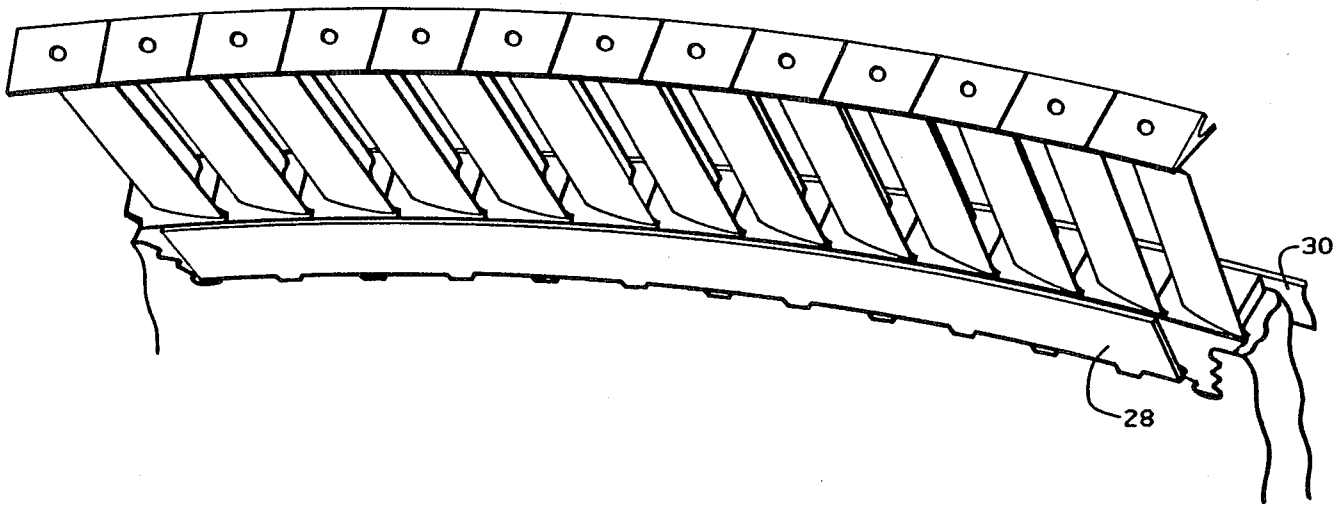
FIG. 3 is a perspsective view illustrating a portion of a turbine equipped with the present invention.

According to the invention, a small gap 19 is provided between the bottom-most portion of ones of the roots 16 and the bottom of the grooves 18 with which those roots register. The gap may be provided by either machining the bottom-most surface of the ones of the roots or by machining the bottom of the grooves with which those roots register, or both. An annular plate 28 having an outside radius $r_1$, approximate the radius of the disc 20 plus the thickness of the blade platform 14 is provided. (As shown in the drawings, the annular plate 28 is actually a plurality of sections together defining an annular plate. Thus, it should be understood that, as used herein and in the accompanying claims, the term "annular plate" includes both a unitary plate and a plurality of sections together defining an annular plate.) The annular plate 28 has an inside radius $r_2$ approximate the radial distance from the center of the disc 20 to the bottom of the grooves 18. When assembled to the rotor as described below, the annular plate 28 will be juxtaposed one of the inlet or exit sides of the disc 20 and will overlay each of the grooves 18 on the side of the disc 20 on which plate 28 is placed, as well as overlay faces of the blade platforms 14 disposed on the side of the disc 20 on which plate 28 is placed. See FIG. 3. In FIGS. 2 and 3, a first annular plate 28 and a second annular plate 30 are shown as being juxtaposed the exit side O and inlet side I, respectively, of the disc 20, but it is to be understood that only one plate is required, i.e., on either the inlet side I or exit side O. For convenience, the invention will first be described as having only one plate 28 on the exit side O, then as also having a plate 30 on the inlet side I, but the invention is not limited to these configurations.

The annular plate 28 is provided with integral retaining means for maintaining the plate 28 juxtaposed the exit side O of the disc 20. Preferably, the retaining means is embodied as a plurality of integral, spaced apart prongs 32 that are spaced to mate with selected ones of the gaps 19. Preferably, the prongs 32 mate with gaps disposed in every other root/groove combination, as shown. The prongs 32 extend through the gaps 19 and a free end thereof is bent either radially outward or radially inward on the inlet side I of the disc 20. (The prongs are shown in the drawings as being bent radially outward, for convenience.) If the prongs are bent radially outward, the free end of each is preferably seated in a recessed area in the inlet side face of the root beneath which it extends, as will become evident hereinafter.

As mentioned, a second annular plate 30 may be provided (but is not required) on the inlet side I of the disc 20. Preferably, the construction and dimensions of the second plate 30 are substantially identical to those of the annular plate 28. (The inner radius of the second plate 30 may have to be decreased slightly to allow covering of the bent prongs 32 of the first plate 28.) Thus, annular plate 30 has a plurality of integral, spaced apart prongs 34 for mating with ones of the gaps 19. When the annular plate 30 is installed as shown, it is juxtaposed the inlet side I of the disc, as best shown in FIG. 3. Prongs 34 preferably extend through other ones of the gaps 19 than the prongs 32 of plate 28. As shown, it is preferred that the prongs 32, 34 by interleaved.

Figure 4:
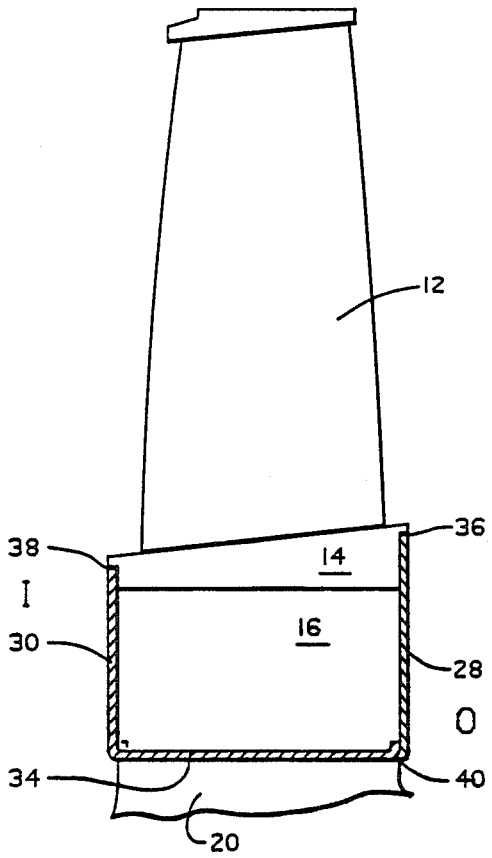
FIG. 4 is a side view of one blade in the turbine and illustrates the cooperation between the blade and various elements of the invention.

As in the case of annular plate 28, it is preferred that, if annular plate 30 is provided, the free ends 40 of the prongs 34 be bent either radially outward or radially inward on the exit side O of disc 20. See FIG. 4. If bent radially outward, it is also preferred that the free end 40 be seated in a recessed area on the exit side face 17, as shown.

Steps 36, 38 (FIG. 4) may be provided on the exit and inlet sides, O, I, respectively, of the platforms 14 to additionally offset centrifugal loading on the plates 28, 30.

A preferred method of assembling a row of turbine blades to incorporate the apparatus of the present invention comprises the steps of machining ones of the roots 16 and grooves 18 so that there is a gap 19 between the bottom-most portion of ones of the roots 16 and the bottom of grooves 18 with which the ones of the roots 16 register; inserting the prongs 32 (34) of an annular plate 28 (30) into ones of the gaps 19, and juxtaposing the annular plate 28 (30) either the inlet side I or the exit side O of the disc 20 so that it overlays both the grooves 18 in the disc 20 and the faces of the platforms 14 on the side of the disc on which the plate 28 (30) is juxtaposed; then bending free ends of the prongs 32 (34) either radially outward or radially inward on the side of the disc 20 opposite that on which the plate is juxtaposed. The method may also comprise the steps of machining a recess in faces of ones of the roots and seating the free end of each prong 32 in the recesses, if the prongs are to be bent radially outward.

If it is desired to incorporate a second annular plate 30 (28), then the method may comprise the further steps of inserting the prongs 34 (32) into other ones of the gaps 19 than the prongs 32 (34) and juxtaposing the second annular plate 30 (28) the side of the disc 20 opposite that on which plate 28 (30) is juxtaposed; then bending the free ends 40 of the prongs 34 (32) either radially outward or radially inward on the side of disc 20 opposite that on which the plate 30 (28) is juxtaposed. As before, it may be desired to machine a recess in faces of ones of the roots 16 and seat the free end 40 of each prong 34 (32) in the recesses if the prongs 34 (32) are to be bent radially outward. If both annular plates 28, 30 are utilized, then it is preferred that the method include the further step of interleaving the prongs 32, 34 as illustrated in FIG. 3.

The apparatus and method of the present invention provides the following advantages.

1. The annular plates minimize leakage area between and under the blade platforms (clearance areas 22), as well as between the root/groove combinations (clearance areas 24).

2. The annular plates eliminate rough surfaces formed by axial misalignment of the blade roots with the disc, and thereby reduce windage.

3. The annular plates are readily removable for inspection and/or replacement.

4. The annular plates can be simply manufactured from a single sheet of metal.

5. If the annular plate is constructed from several sections, the number of sections required for any blade row can be adjusted for a specific blade design.

6. The annular plates can be retrofitted to existing turbines or applied in new designs. Minimal additional machining is required.

7. For blades with a standard platform wing (foil) trailing edge support, as illustrated in FIG. 1), the annular plates lock a row of blades axially in the disc. Half of the blades are prevented from sliding downstream by the one annular plate, and the other half (i.e., every alternate blade) is held from moving upstream by the other annular plate. Thus, each pair of adjacent blades is interlocked as illustrated in FIGS. 2 and 3.

The present invention may be embodied in other specific forms without departing from the spirit or essential attributes thereof and, accordingly, reference should be made to the appended claims, rather than to the foregoing specification, as indicating the scope of the invention.

I claim as my invention:

1. In a turbomachine having a disc with an inlet side and an exit side, a plurality of generally axially extending grooves therearound, and a plurality of blades, each blade having a platform and a root in registration with one of the grooves, an apparatus for reducing windage loss and leakage comprising:

an annular plate juxtaposed one of the inlet or exit sides of the disc and overlaying the grooves and faces of the platforms, the annular plate having integral retaining means for maintaining the plate juxtaposed the disc, the internal retaining means extending into the disc, the annular plate having an outside radius approximate the radius of the disc plus the thickness of the platforms and an inside radius approximate the radius form the center of the disc to the bottom of the grooves, the annular plate covering the rough surfaces caused by imprecise alignment between faces of the roots and the disc and between adjacent platforms, and covering gaps between the roots and the disc and between and under adjacent platforms.

2. Apparatus according to claim 1 wherein the retaining means comprises a plurality of spaced apart prongs, there being a gap between the bottom-most portion of ones of the roots and the bottom of the grooves with which the ones of the roots register, the prongs extending through selected ones of the gaps.

3. Apparatus according to claim 2 wherein each prong has a free end bent radially along the disc on the side of the disc opposite that on which the plate is juxtaposed.

4. Apparatus according to claim 3 wherein the free end of each prong is seated in a recessed area in a face of a root.

5. Apparatus according to claim 1 wherein the grooves and roots have a generally fir tree shape.

6. Apparatus according to claim 1 wherein the annular plate defines a first annular plate, further comprising a second annular plate juxtaposed the side of the disc opposite that on which the first annular plate is juxtaposed, the second annular plate having integral retaining means for maintaining the second annular plate juxtaposed the disc.

7. Apparatus according to claim 3 wherein the annular plate defines a first annular plate, further comprising a second annular plate juxtaposed the side of the disc opposite that on which the first annular plate is juxtaposed, the second annular plate having an outside and inside radius substantially that of the first annular plate, the second annular plate having a plurality of integral, axially extending, spaced apart prongs extending through other one of the gaps than the prongs of the first annular plate, each prong of the second annular plate having a free end bent radially along the disc on the side of the disc opposite that on which the second annular plate is disposed, the free end of each prong of the second annular plate being seated in a recessed area in a face of a root.

8. Apparatus according to claim 7 wherein the prongs of the first and second annular plates are interleaved.

9. Steam turbine comprising:

(a) a disc having a plurality of generally fir tree shaped, generally axially extending grooves disposed therearound, there being an inlet side and an exit side of the disc;

(b) a plurality of blades circularly disposed around the disc, each blade having a platform and a generally fir tree shaped root in registration with one of the grooves, there being a gap between the bottom-most portion of ones of the roots and the bottom of the grooves with which the ones of the roots register;

(c) an annular plate having an outside radius approximate the radius of the disc plus the thickness of the root and an inside radius approximate the radial distance from the center of the disc to the bottom of the grooves, the annular plate being juxtaposed on the inlet or exit sides of the disc and overlaying the grooves and faces of the platforms, the annular plate thereby reducing windage loss caused by imprecise alignment between faces of the roots and platforms and the disc, and further reducing leakage through gaps between the roots and the disc and between and under adjacent platforms, the annular plate further having a plurality of integral, axially extending, spaced apart prongs extending through selected ones of the gaps, each prong having a free end bent radially along the disc on the side of the disc opposite that on which the plate is juxtaposed, the free end of each prong being seated in a recessed area in a face of a root,

10. Steam turbine according to claim 9 wherein the annular plate defines a first annular plate, further comprising a second annular plate juxtaposed the side of the disc opposite that on which the first annular plate is juxtaposed and overlaying the grooves and faces of the platforms, the second annular plate having an outside and inside radius substantially that of the first annular plate, the second annular plate having a plurality of integral, axially extending, spaced apart prongs extending through other ones of the gaps than the prongs of the first annular plate, each prong of the second annular plate having a free end bent radially along the disc on the side of the disc opposite that on which the second annular plate is juxtaposed, the free end of each prong of the second annular plate being seated in a recessed area in a face of a root.

11. Steam turbine according to claim 10 wherein the prongs of the first and second annular plates are interleaved.

12. In a steam turbine of the type having a disc with an inlet side and an exit side and a plurality of generally axially extending grooves disposed therearound and a plurality of blades, each blade having a platform and a generally fir tree shaped root in registration with one of the grooves, a method of assembling the turbine to reduce windage and leakage comprising the steps of:

(a) providing an annular plate having an outside diameter approximate the radius of the disc plus the thickness of the platform and further having a plurality of integral, spaced apart, axially extending prongs;

(b) machining ones of the roots and grooves so that there is a gap between the bottom-most portion of the ones of the roots and the bottom of the grooves with which the ones of the roots register;

(c) inserting the prongs into ones of the gaps and juxtaposing the annular plate on one of the sides of the disc so that it overlays the grooves and faces of the platforms; and (d) bending free ends of the prongs radially along the disc on the side of the disc opposite that on which the plate is juxtaposed.

13. Method according to claim 12 wherein the annular plate provided in step (a) defines a first annular plate further comprising the steps of:

(g) providing a second annular plate substantially identical in size to the first annular plate, the second annular plate having a plurality of integral, spaced apart, axially extending prongs;

(h) inserting the prongs of the second annular plate into other ones of the gaps than the prongs of the first annular plate and juxtaposing the second annular plate the side of the disc opposite that on which the first annular plate is juxtaposed;

(i) bending free ends of the prongs of the second annular plate radially along the disc on the side of the disc opposite that one which the second annular plate is disposed.

14. Method according to claim 13 further comprising the step of interleaving the prongs of the first and second annular plates.

* * * * *